US005105890A

United States Patent [19]

Duguid et al.

[11] Patent Number: 5,105,890

[45] Date of Patent: Apr. 21, 1992

[54] APPARATUS FOR ALTERING THE LENGTH OF A DOWNHOLE TOOL ASSEMBLY

[75] Inventors: Grant A. Duguid, New Deer, Scotland; Kenneth Davis, Ruidoso, N. Mex.; Dennis T. Steed, Newachar, Scotland.

[73] Assignee: Bottom Hole Technology Limited, Aberdeen, United Kingdom

[21] Appl. No.: 609,419

[22] Filed: Nov. 5, 1990

[30] Foreign Application Priority Data

Nov. 4, 1989 [GB] United Kingdom ..... 8924944
Aug. 17, 1990 [GB] United Kingdom ..... 9018085
Oct. 12, 1990 [GB] United Kingdom ..... 9022210

[51] Int. Cl.[5] ..... E21B 17/07

[52] U.S. Cl. ..... 166/380; 166/381; 175/321

[58] Field of Search ..... 175/320, 321; 166/380, 166/381, 242; 285/306

[56] References Cited

U.S. PATENT DOCUMENTS 3,763,666 10/1973 Tibussek ..... 64/23
4,040,649 8/1977 Blackwell ..... 285/3
4,055,226 10/1977 Weber ..... 175/273
4,113,038 9/1978 Clark ..... 175/300
4,693,316 9/1987 Ringgenberg et al. ..... 166/355
4,844,181 7/1989 Bassinger ..... 175/195

FOREIGN PATENT DOCUMENTS 0231592 10/1986 European Pat. Off. .
2731170 7/1977 Fed. Rep. of Germany .
2593226 1/1986 France .

*Primary Examiner*—William P. Neuder
*Attorney, Agent, or Firm*—Ratner & Prestia

[57] ABSTRACT

Apparatus for altering the length of a down-hole tool assemblly is described. The apparatus comprises a main housing (1), a slide (13) movable within the housing between a retracted position and an extended position, and latching means (6,755,33,41) to releasably secure the slide (13) to the housing (1) when the slide (13) is in either the extended position or the retracted position. The latching means (6,7,33,41,55) is activated and deactivated by fluid pressure within the apparatus where the apparatus forms part of a drill string, the fluid is typically drilling mud which is pumped through the drill string and the apparatus and the pressure is changed by changing the rate of mud flow through the drill string.

10 Claims, 7 Drawing Sheets

APPARATUS FOR ALTERING THE LENGTH OF A DOWNHOLE TOOL ASSEMBLY

The invention relates to apparatus for altering the length of a down-hole tool assembly, and in particular apparatus for altering the length of a drill string.

BACKGROUND OF THE INVENTION

Directional drilling requires great skill and a suitable repertoire of tools. Among the techniques used by a directional driller is the selection of a proper drill bit. When a particular drill bit is combined with a specific near-bit assembly, a unique and usually predictable turning behavior is obtained. However, if the driller desires to change this behavior, he must remove the drill string and drill bit from the hole and establish a new down-hole assembly.

Removing the drill string and bit from the hole is an expensive operation and may delay the drilling operation by more than a day.

SUMMARY OF THE INVENTION

In accordance with one aspect of the present invention, apparatus for altering the length of a down-hole tool assembly comprises a main housing, a slide movable within the housing between a retracted position and an extended position, latching means to releasably secure the slide to the housing when the slide is in the retracted position or the extended position, wherein the latching means is activated and de-activated by the pressure of a fluid within the apparatus, and the apparatus being adapted to connect two adjacent sections of the down-hole assembly so that movement of the slide from the retracted position to the extended position increases the length of the assembly and movement of the slide from the extended position to the retracted position decreases the length of the assembly.

In accordance with another aspect of the present invention a method of altering the length of a down-hole tool assembly comprises changing the pressure of fluid within the assembly to deactivate a latching means to enable a slide, connected to one section of the tool assembly and being located within a housing which is connected to a second section of the tool assembly, to move relative to the housing, moving the slide within the housing to alter the length of the tool assembly and thereafter reversing the change in the fluid pressure within the assembly to activate the latching means to secure the slide to the housing.

Preferably, the latching means comprises at least one latch member which may be a latch ball or a latch cylinder located in the slide and which co-operates with recesses on the inside of the housing when the slide is in the retracted or the extended position. Where the latching means comprises a latch cylinder then, preferably, the slide has a polygonal cross-section.

Typically, the down-hole tool assembly is a drill string and the apparatus is located between a drill bit and the drill string.

Preferably, the housing comprises at least one stabilizing fin mounted on the exterior of the housing to engage with the side walls of the hole.

Typically, the apparatus further comprises biasing means to bias the slide either to the retracted position or the extended position, and the biasing means may be provided by the fluid pressure within the apparatus.

However, in an alternative example the biasing means could comprise a spring.

When the down-hole tool assembly is a drill string then preferably, the fluid used to activate and deactivate the latching means is the mud which is pumped through the drill string.

Typically, the latching means is activated to secure the slide to the housing when the mud flow within the apparatus is high and the latching means is deactivated when the mud flow within the apparatus is low.

Preferably, the latching means comprises a restrictor in the path of the mud flow which creates a pressure differential between the mud flow entering the apparatus and the mud flow exiting the apparatus.

Preferably, the mud flows through a central bore of the apparatus and the restrictor is located within the central bore on a latch piston.

Typically, the latching means also comprises biasing means to bias the latching means towards the deactivated position.

Typically, the slide is only securable to the housing at the retracted position and the extended position; however it is possible that a number of intermediate securing positions could also be provided.

Preferably, the mud pressure within the apparatus is low when the mud pumps are idling and is high when the mud pumps are pumping mud during drilling.

In one example of the invention movement of the slide within the housing activates a pad located in the housing so that when activated the pad extends from the outside surface of the housing and when the pad is not activated the pad is flush or recessed within the outside surface of the housing. Movement of the slide could be used to activate more than one pad, for example four pads, disposed circumferentially and/or axially with respect to each other within the housing.

Where there is only one pad located in the housing and activated by the slide, the apparatus could be adjacent to a bent housing mud motor, such as an eccentric bent housing mud motor, so that the apparatus does not rotate relative to the hole and activation of the pad could be used to increase the angle of inclination of a well being drilled.

BRIEF DESCRIPTION OF THE DRAWINGS

Examples of apparatus for altering the length of a down-hole tool assembly in accordance with the invention will now be described with reference to the accompanying drawings, in which.

DESCRIPTION OF PREFERRED EMBODIMENTS

Figure 1:
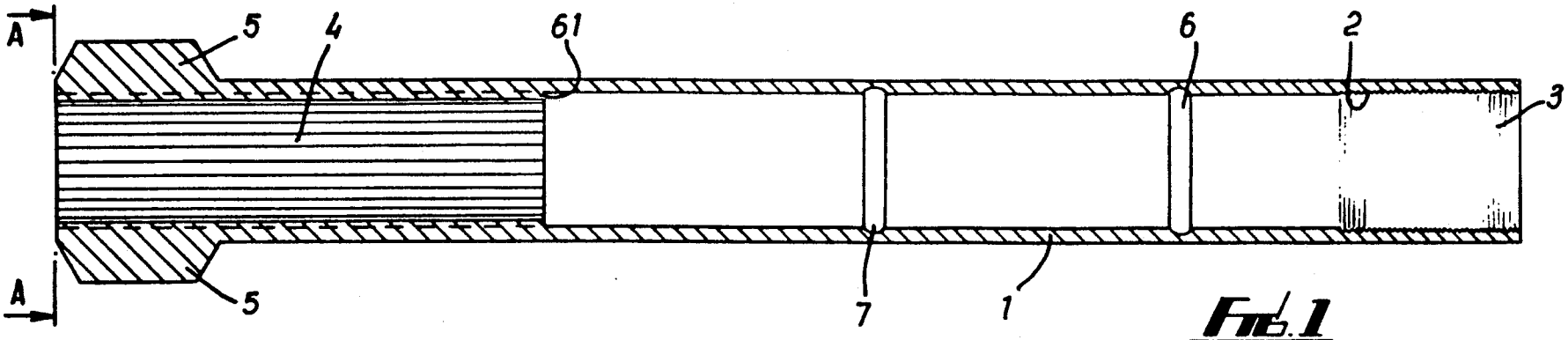
FIG. 1 is a cross-sectional view through a main housing of a first example of the apparatus.
Figure 2:
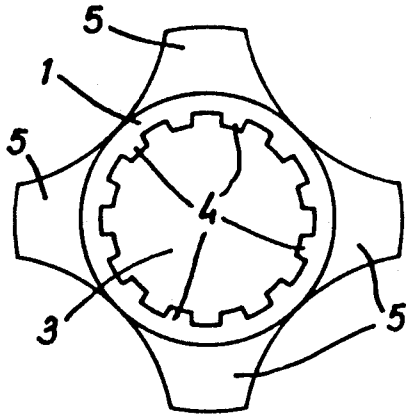
FIG. 2 is an end view of the housing shown in FIG. 1 along the line A—A.

FIG. 1 shows a housing 1 which has a through bore 3. The through bore 3 has an internal thread 2 at one end and has a number of splines 4 at the other end. On the exterior of the housing 1 at the splined end there are four stabilizer fins 5 (see also FIG. 2). On the inside surface of the housing 1 between the spline end 4 and the threaded end 2 are located an upper latch groove 6 and a lower latch groove 7.

Figure 3:
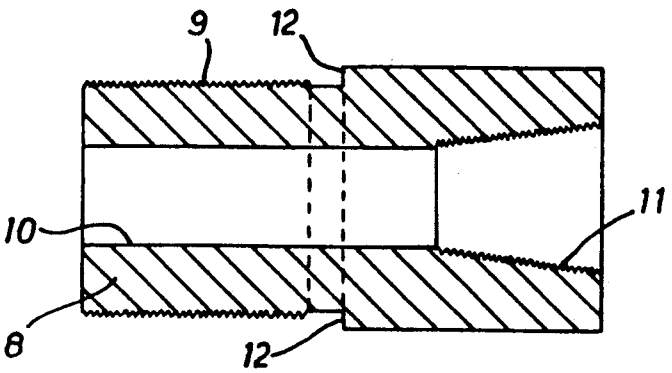
FIG. 3 is a cross-sectional view through an end plug for attachment to the housing shown in FIG. 1.

An end plug 8, shown in FIG. 3, has an externally threaded end 9 which screws into the threaded end 2 of the housing 1. The end plug 8 also has a through bore 10 which is internally threaded at end 11 opposite to the externally threaded end 9 and a shoulder 12 separates the externally threaded end 9 from the internally threaded end 11.

Figure 4:
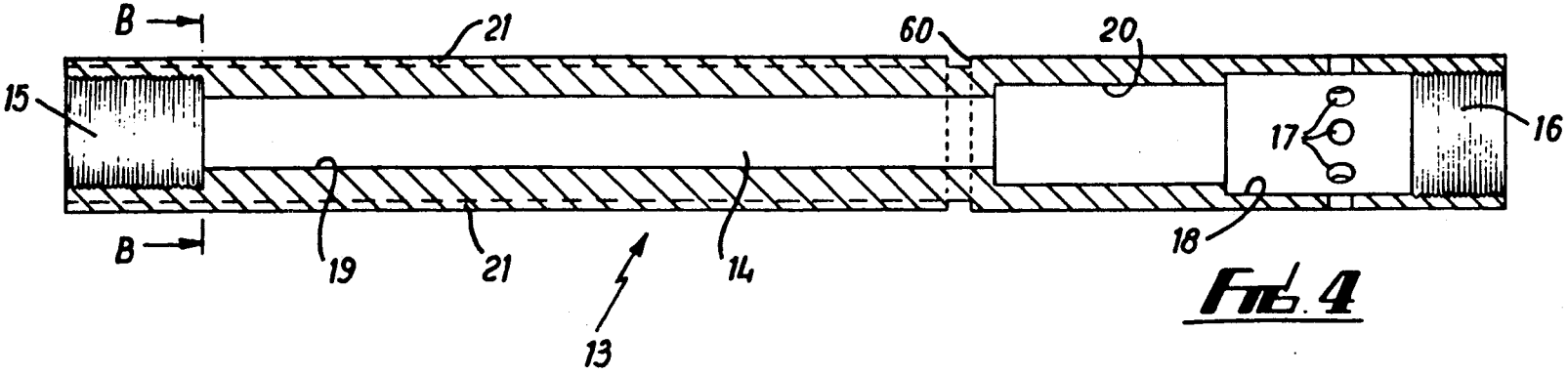
FIG. 4 is a cross-sectional view through a slide to be located within the housing shown in FIG. 1.
Figure 6:
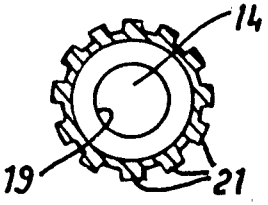
FIG. 6 is a cross sectional end view along the line B—B in FIG. 4.

FIG. 4 shows a slide 13 with a through bore 14. The through bore 14 is threaded at each end 15, 16 and has eight equally spaced apertures 17 located adjacent the threaded end 16 in a large diameter section 18 of the bore 14. The bore 14 also has a narrow diameter section 19 and an intermediate diameter section 20, as shown in FIG. 4. The slide 13 has a number of splines 21 (see also FIG. 6) located longitudinally along the external surface of the narrow bore section 19 and the threaded end 15.

Figure 5:
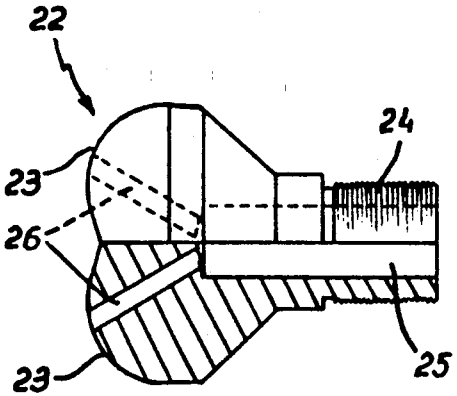
FIG. 5 shows a drill bit for attachment to the slide shown in FIG. 4.

FIG. 5 shows a drill bit 22 which has a cutting surface 23 at one end and is externally threaded at the other end 24. The threaded end 24 engages with the threaded end 15 of the slide so that the drill bit 22 may be secured to the slide 13. The drill bit 22 has a bore 25 which aligns with the bore 14 in the slide when the drill bit 22 is connected to the slide 13. At the cutting end 23 of the drill bit 22 the bore 25 divides into two fluid ports 26 which distribute mud flowing from the slide 13 into the bore 25 to the cutting surface 23 of the drill bit 22.

Figure 7:
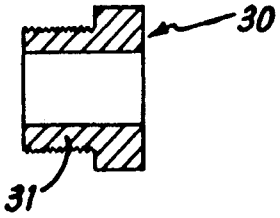
FIG. 7 is a cross-sectional view through a retainer for attachment to the slide shown in FIG. 4.

FIG. 7 illustrates a retainer 30 which has an externally threaded end 31 which co-operates with the threaded end 166 of the slide 13 so that the retainer 30 may be secured to the slide 13.

Figure 10:
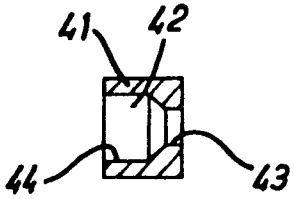
FIG. 10 is a cross-sectional view through a restrictor for insertion into the latch piston shown in FIG. 9.
Figure 9:
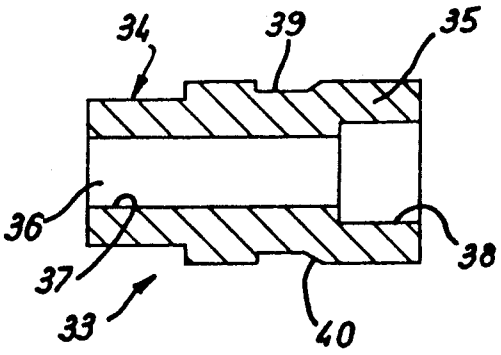
FIG. 9 is a cross-sectional view through a latch piston for use in the slide shown in FIG. 4.
Figure 8:
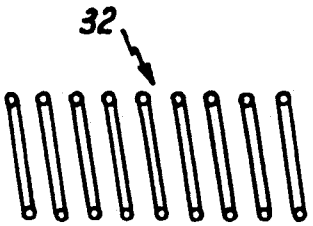
FIG. 8 is a cross-sectional view through a helical spring for use in the slide shown in FIG. 4.

FIG. 8 illustrates a helical spring 32 which is located within the intermediate diameter section 20 of the slide 13 when the apparatus is assembled. FIG. 9 illustrates a latch piston 33 having a narrow end 34 and a wide end 35. The latch piston 33 also has a through bore 36 with a narrow section 37 and a wide section 38. On the external surface of the latch piston 33 between the narrow end 34 and the wide end 35 is a recess 39 with a sloping shoulder 40. FIG. 10 shows a restrictor 41 having a through bore 42x and the restrictor 41 is designed to be inserted into the wide bore section 38 of the piston 33. As shown in FIG. 10, the through bore 42 of the restrictor 41 has a narrow section 43 and a wide section 44.

Figure 11:
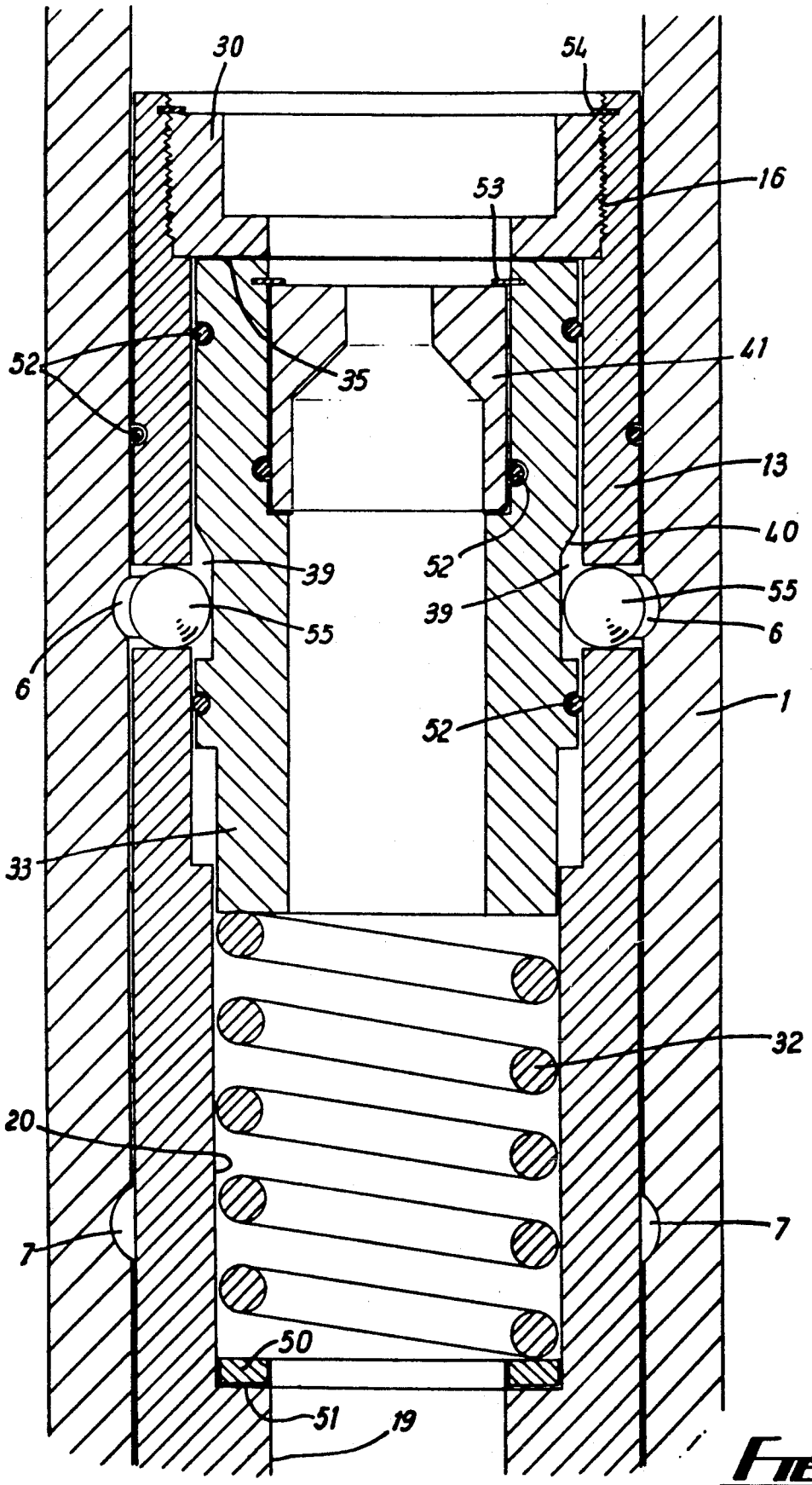
FIG. 11 is a cross sectional view through a part of the first example of the apparatus when the components in FIGS. 1, 2, 4 and 6 to 10 have been assembled.

As shown in FIG. 11 the slide 13 is inserted into the housing 1 and the splines 21 (see FIG. 4) on the slide engage with the corresponding splines 4 (see FIG. 1) on the inside of the housing 1 so that rotation of the slide 13 relative to the housing 1 is prevented. An adjustment shim 50 is inserted into the intermediate diameter section 20 of the slide 13 so that it abuts against a shoulder 51 separating the intermediate bore 20 from the narrow bore 19 of the slide 13. The helical spring 32 is then inserted into the intermediate section 20 so that it sits on the adjustment shim 50 and the latch piston 33 is then inserted into the wide bore section 18 of the slide 13 so that the narrow end 34 of the latch piston 33 sits on top of the helical spring 32.

Prior to insertion of the latch piston 32 into the slide 13 the restrictor 41 is inserted into the wide bore section 38 of the latch piston 33 and is sealed there by means of an 0-ring 52 and held in place by a snap ring retainer 53. When the latch piston 33 is initially inserted into the slide 13 the end 35 of the latch piston 33 projects into the threaded end 16 of the slide 13. When the retainer 30 is screwed into the end 16, the retainer 30 abuts against the end 35 of the latch piston 33 and pushes the latch piston 33 against the bias of the spring further into the slide 13 so that the latch piston 33 slightly compresses the helical spring 32. The retainer 30 is then held in place by means of a snap retainer 54.

The slide 13 with the helical spring 32, the latch piston 33, the restrictor 41 and the retainer 30 is then inserted into the housing 1 and as it is inserted into the housing latching balls 55 are inserted into the apertures 17. The balls 55 project into the recess 39 in the side wall of the latch piston 33. Movement of the slide 13 in the housing 1 is limited by shoulders 60, 61 on the slide 13 and the housing 1 respectively. When the shoulders 60, 61 abut, the apertures 17 and the latching balls 55 are adjacent the lower latch groove 7. After the slide 13 has been inserted into the housing 1 the end cap 8 is screwed into the threaded end 2 of the housing 1 to retain slide 13 within the housing 1. When the threaded end 16 of the slide 13 abuts against the end 9 of the end cap 8 the apertures 17 and the latch balls 55 are adjacent the upper latch grooves 6 of the housing 1.

Figure 12A:
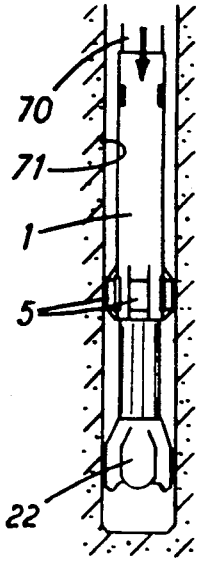
FIGS. 12A to 12C illustrate how the apparatus may be used to increase the separation between a stabilizer and a drill bit.
Figure 12B:
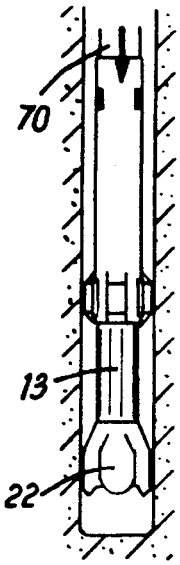
Figure 12C:
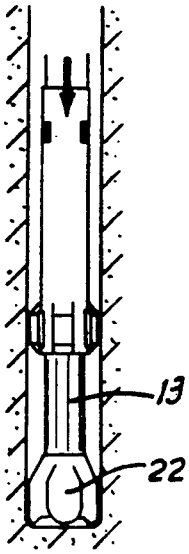

When the latch 13 has been inserted into the housing 1 the drill bit 22 may be attached to the threaded end 15 of the slide 13 and a drill string 70 may be attached to the threaded section 11 of the end plug 8. The various components within the housing 1 are sealed within the housing by means of a number of O-rings 52. In use, the assembled apparatus, and the attached drill bit 22 and drill string 70 are inserted into a hole 71. In order to extend the separation of the drill bit 22 and the stabilizer fins 5, the mud pumps forcing mud through the drill string, the apparatus and the drill bit are switched to idle so that the latch piston is in the position shown in FIG. 11. In this position the latch balls 55 do not engage the latch grooves 6 as the idling mud flow pressure on the restrictor 41 is not sufficient to compress the helical spring 32. However, the mud flow pressure against the end of the slide 13 is sufficient to move the slide 13 relative to the housing 1 so that the shoulder 60 moves towards the shoulder 61 and the slide moves to the extended position in which the latch balls 55 are adjacent the lower latch groove 7 and the drill bit 22 is at its maximum separation from the stabilizer fins 5 as shown in FIG. 12A. When this position has been achieved the mud flow pressure is increased and this acts on the restrictor 41 and forces the piston 33 downwards against the biasing action of the helical spring 32. This forces the shoulders 40 against the latching balls 55 and pushes them into engagement with the lower latch groove 7. Hence, the slide 30 is locked to the housing 1, as shown in FIG. 12B and the drill bit may then be forced against the bottom of the hole, as shown in FIG. 12C in order to continue drilling and due to the high mud flow pressure acting on the restrictor 41 the slide 13 will be locked in the extended position.

Figure 13A:
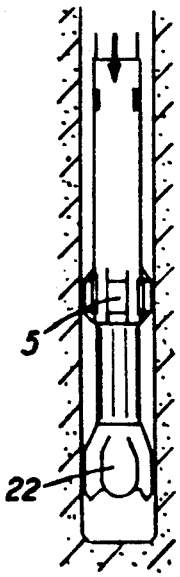
FIGS. 13A to 13D show how the apparatus may be used to decrease the separation between a stabilizer and a drill bit.
Figure 13B:
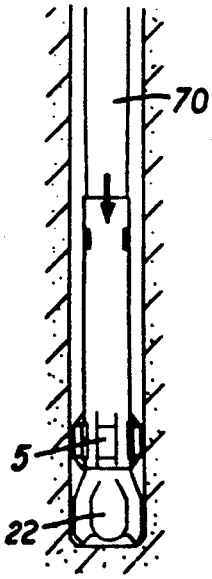
Figure 13C:
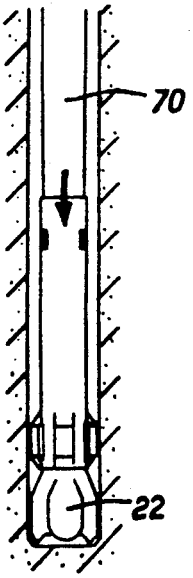
Figure 13D:
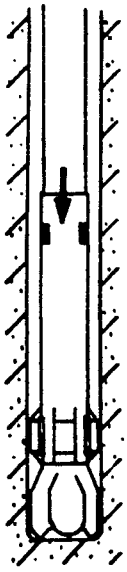

In order to decrease the separation of the drill bit 22 and the stabilizer fins 5 the mud flow pressure is switched to idle, as shown in FIG. 13A. This reduces the pressure on the restrictor 41 sufficiently to enable the spring 32 to force the latch piston 33 to the position shown in FIG. 11 so that the latch balls disengage from the lower latch groove 7. The drill string 70 and the drill bit are then forced against the bottom of the hole and further load on the drilling string 70 causes the slide 13 to move from the extended position to the retracted position as the drill bit is held stationary by the bottom of the hole. The latch balls 55 are now adjacent the latch groove 6 and the drill bit 22 is adjacent the stabilizer fins 5, see FIG. 13B. The mud flow is then switched to high pressure and this again forces the latch piston 33 to compress the helical spring 32 and the shoulders 40 force the latch bulbs 55 into engagement with the latch groove 6 as shown in FIG. 13C and the high pressure mud flow within the apparatus maintains the slide 13 in the retracted position during drilling as shown in FIG. 13D.

Figure 14:
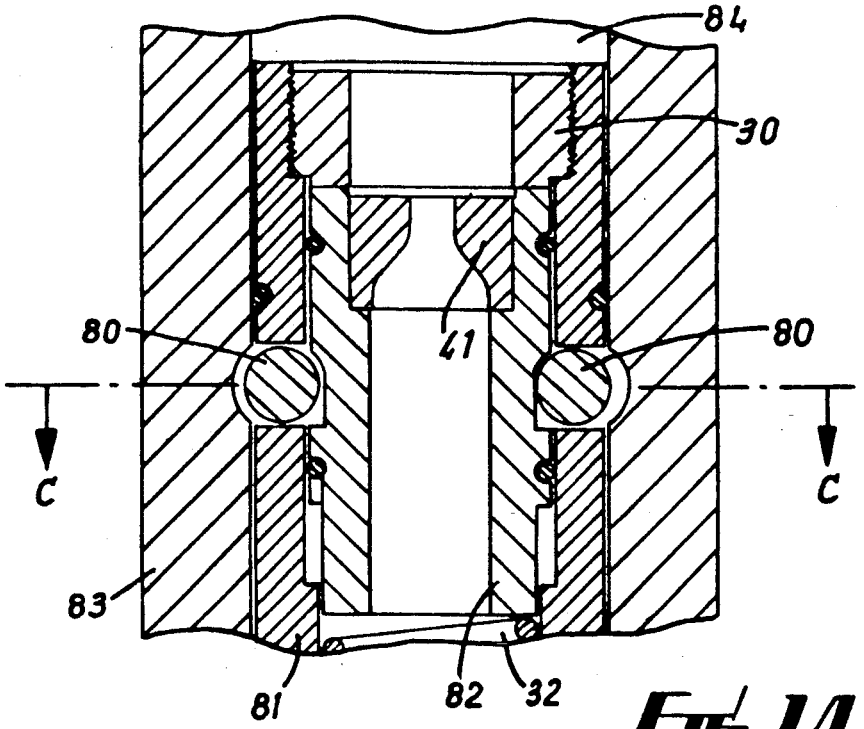
FIG. 14 is a cross-sectional view through a part of a second example of the apparatus.
Figure 15:
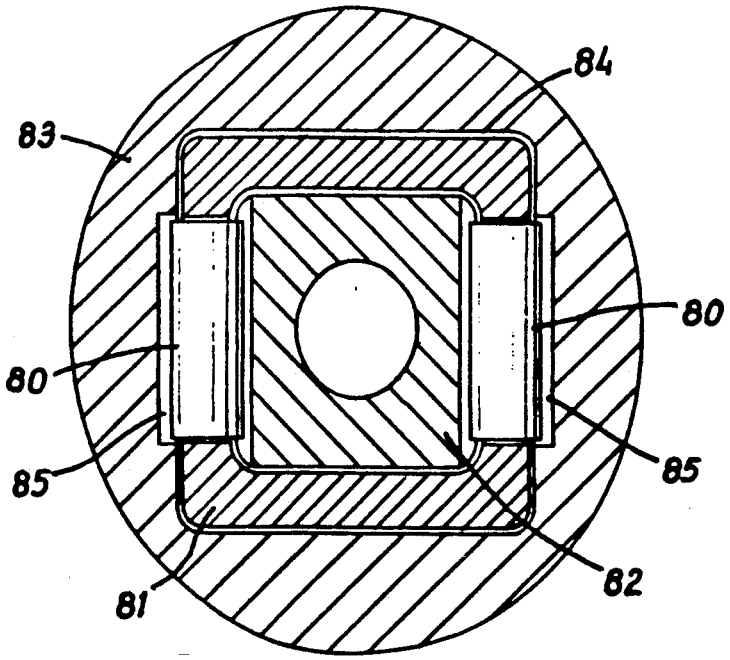
FIG. 15 is a cross-sectional view along the line C—C in FIG. 14.

FIGS. 14 and 15 show a second example of the apparatus in which the latch balls 55 are replaced with two latch cylinders 80. A slide 81 and a piston 82 are also provided which are similar to the slide 13 and the piston 33 shown in FIG. 11, except that the slide 81 and the piston 82 both have a rectangular cross-section (see FIG. 15) to accommodate the latch cylinders 55. In addition, the housing 1 is replaced with a housing 83 which has a rectangular through bore 84 for receiving the slide 81. The components of the apparatus shown in FIGS. 14 and 15 which are the same as the components used in the apparatus shown in FIG. 11 have identical reference numerals to the components shown in FIG. 11. In this second example, the latch cylinders 80 co-operate with latch grooves 85 which have a curved cross-section and which extend along two opposite sides of the through bore 84, as shown in FIG. 15.

The apparatus shown in FIGS. 14 and 15 operates in a similar manner to that described above for the apparatus shown in FIG. 11. However, the advantage of the rectangular cross-section and the latch cylinders 80 is that there is more contact area for the latch cylinders 80. In addition, the square cross-section negates the need for a splined end for the housing 83, as is necessary with the housing 1 in FIG. 1.

As an alternative to a rectangular cross-section any polygonal cross-section could be used, such as hexagonal or octagonal, and the latch cylinders 80 positioned on appropriate sides of the polygon. For example, there could be a latch cylinder on each side of the slide or on alternate sides.

In addition to being used to extend the distance between a stabilizer and a drill bit the apparatus could also be used to alter the separation between two stabilizers and this would also have the effect of changing the angle of the drilling direction.

Figure 16A:
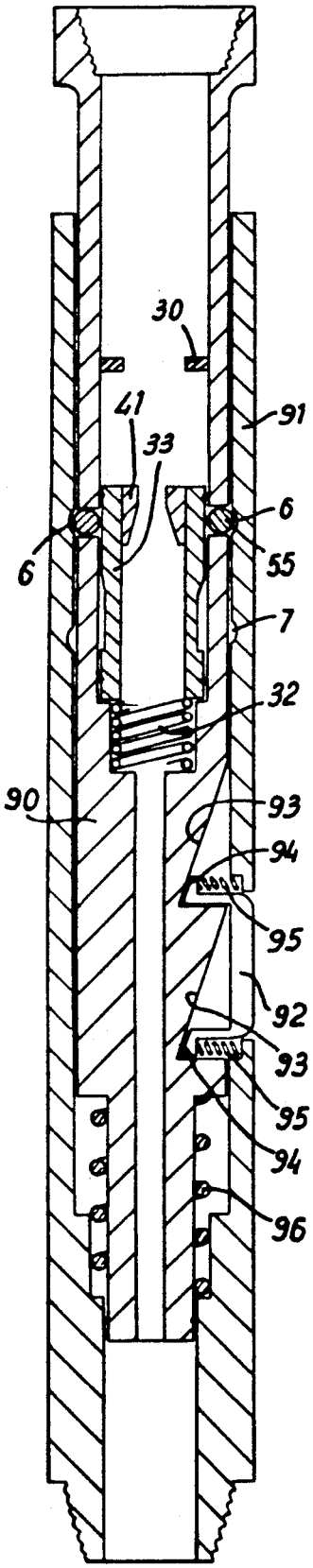
FIGS. 16A to 16C show how the apparatus may be used to activate a pad located in a housing of the apparatus.
Figure 16B:
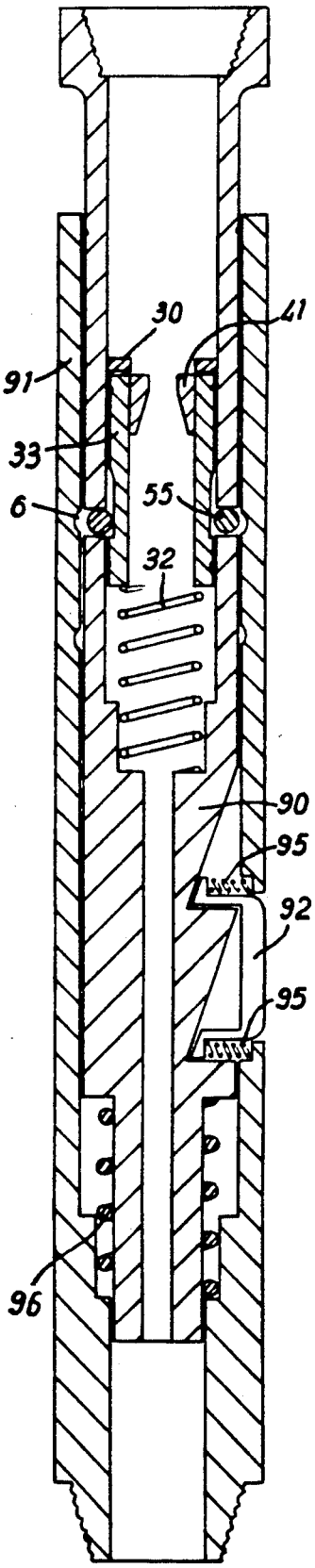
Figure 16C:
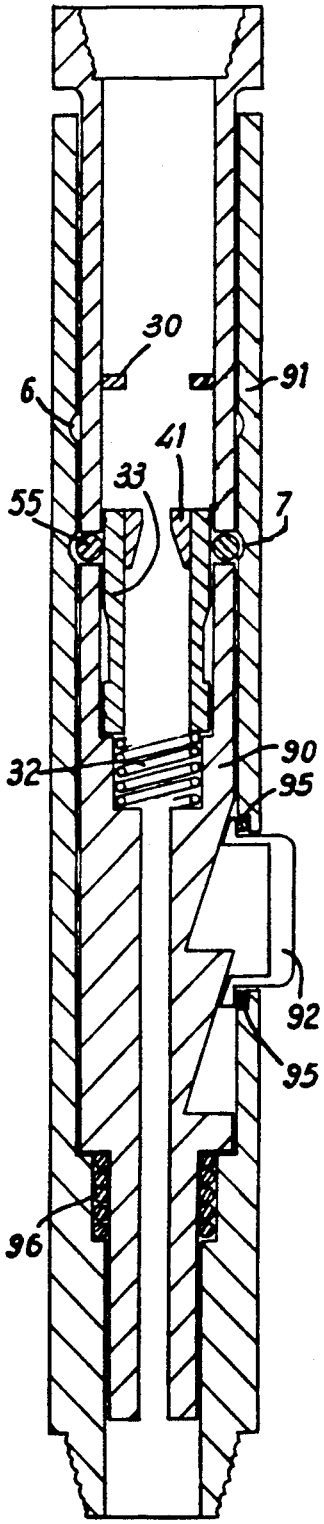

FIGS. 16A to 16C show a third example of the apparatus in which a slide 90 may be moved axially Within a housing 91 to push out a pad 92 from the outside surface of the housing 91.

In this example the slide 90 has two cam surfaces 93 which co-operate with two co-operating cam surfaces 94 on the pad 92 and there are two helical springs 95 located between the housing 91 and the pad 92 to bias the pad 92 to a recessed position, as shown in FIGS. 16A and 16B. There is also a helical spring 96 located between the slide 90 and the housing 91 which biases the slide 90 and housing 91 to the extended position shown in FIGS. 16A and 16B. However, in other respects the apparatus shown in FIGS. 16A to 16C is similar to the apparatus shown in FIG. 11 and identical parts have the same reference numerals.

In use, the apparatus in FIGS. 16A to 16C operates in a very similar manner to the apparatus shown in FIG. 11. In the position shown in FIG. 16A the slide 90 is secured in the extended position by the latch balls 55 being forced into the latch groove 6 by the latch piston 33 under the action of a high mud flow through the tool, and so a high mud pressure on the restrictor 41.

When the mud flow is reduced, the pressure reduces correspondingly, which enables the spring 32 to move the latch piston 33 to the position shown in FIG. 16B. This permits the balls 55 to disengage from the groove 6 so that the slide 90 may be moved relative to the housing 91 to compress the apparatus so that overall length of the apparatus is decreased. As the slide 90 moves in the housing 91, the cam surfaces 93 on the slide 90 push against the cam surfaces 94 on the pad 92 and push the pad 92, against the action of the springs 95, to the extended position shown in FIG. 16C. When the balls 55 are adjacent the groove 7 the mud flow can be increased to cause the piston 33 to move to the position shown in FIG. 16C. This causes the balls 55 to be engaged with the groove 7 to secure the slide 90 to the housing 91 and to maintain the pad 92 in the extended position.

The apparatus shown in FIGS. 16A to 16C may be used in a tool string, adjacent a bent housing mud motor to increase the angle of inclination of the wall being drilled, and is preferably used in conjunction with a bent housing mud motor with an eccentric housing.

In addition more than one pad 92 may be located on the housing 91 so that the apparatus could be used as an adjustable stabilizer in the drill string. Also, the pads 92 could be used with the apparatus shown in FIGS. 14 and 15 with the position of a pad 92 in the housing 91 corresponding to a side of the slide 81.

Modifications and improvements may be incorporated without departing from the scope of the invention.

We claim:

1. Apparatus for altering the length of a down-hole tool assembly in a borehole comprising:

a main housing;

a slide movable within said housing between a retracted position and an extended position; and, latching means to releasably secure said slide to said housing when said slide is in said retracted position or said extended position;

wherein said latching means is activated and deactivated by the pressure of a fluid within said apparatus, and said latching means comprises:

a latch member movable to an engaged position in which said slide is secured to said housing; and, a lock member activated by the pressure of said fluid to lock said latch member in said engaged position; and, wherein said apparatus is adapted to connect two adjacent sections of the down-hole assembly so that movement of said slide from said retracted position to said extended increases the length of the assembly and, movement of said slide from said extended position to said retracted position decreases the length of the assembly.

2. Apparatus according to claim 1, and further comprising biassing means to bias the slide to either the retracted position or the extended position.

3. Apparatus according to claim 2, wherein the biassing means is provided by the pressure of the fluid within the apparatus.

4. Apparatus according to claim 1, wherein the fluid flows through a fluid passage in the apparatus and the latching means comprises means to create a pressure differential within the apparatus when the fluid flows through the apparatus.

5. Apparatus according to claim 1, and further comprising a radially movable pad mounted on the housing and can means to couple the pad to the side so that movement of the slide radially extends the pad from the outside surface of the housing.

6. Apparatus according to claim 1, wherein the latch member is mounted on the slide, the latch member cooperating with recesses on the inside of the housing when the slide is in the retracted or extended position.

7. Apparatus according to claim 1, wherein the slide has a polygonal cross-section.

8. A method of altering the length of a down-hole tool assembly comprising the steps of:

providing apparatus comprising a housing, a slide movable within the housing between a retracted position and an extended position and latching means to releasably secure the slide to the housing when the slide is in the retracted position or the extended position;

wherein said latching means is activated and deactivated by the pressure of a fluid within said apparatus, and said latching means comprises a latch member movable to an engaged position in which said slide is secured to said housing and a lock member activated by the pressure of said fluid to lock said latch member in said engaged position;

connecting the slide to one section of the tool assembly;

connecting the housing to a second section of the tool assembly;

changing the pressure of fluid within the assembly to deactivate the lock member and permit the latching member to move to the disengaged position; moving the slide within the housing to alter the length of the tool assembly; and, reversing the change in the fluid pressure within the assembly to activate the latching mechanism which causes the latching member to move to the engaged position and the lock member to lock the latching member in the engaged position.

9. A method according to claim 8, wherein the first section of the tool assembly is a drill bit and the second section is a drill string, and the method further comprises pumping the fluid through the tool assembly at different rates to create the pressure changes within the assembly.

10. A method according to claim 8, the method further comprising providing a radially movable pad mounted on the housing and cam means to couple the pad to the slide; and moving the slide within the housing to extend the pad in a radial direction relative to the longitudinal axis of the tool assembly.

* * * * *